US007746728B2

(12) United States Patent
Brock

(10) Patent No.: US 7,746,728 B2
(45) **Date of Patent: *Jun. 29, 2010**

(54) TIMER AND DISPLAY DEVICE

(76) Inventor: Steve Brock, 123 Georgian Dr., Coppell, TX (US) 75019

( * ) Notice: Subject to any disclaimer, the term of this patent is extended or adjusted under 35 U.S.C. 154(b) by 1026 days.

This patent is subject to a terminal disclaimer.

(21) Appl. No.: 11/228,789

(22) Filed: Sep. 16, 2005

(65) Prior Publication Data

US 2006/0050616 A1 Mar. 9, 2006

Related U.S. Application Data

(63) Continuation of application No. 10/391,262, filed on Mar. 18, 2003.

(51) Int. Cl.
*G04B 47/00* (2006.01)
*G04F 10/00* (2006.01)
*G04F 8/00* (2006.01)

(52) U.S. Cl. ..... 368/10; 368/89; 368/223

(58) Field of Classification Search ..... 368/10, 368/89, 28, 29, 327, 223; 708/111, 112
See application file for complete search history.

(56) References Cited

U.S. PATENT DOCUMENTS 4,726,687 A * 2/1988 Gander ..... 368/10
5,031,161 A * 7/1991 Kendrick ..... 368/29
5,588,240 A * 12/1996 Zilliox ..... 40/729
6,069,848 A * 5/2000 McDonald et al. ..... 368/107
6,373,817 B1 * 4/2002 Kung et al. ..... 370/217
6,483,779 B1 * 11/2002 Teixeira ..... 368/10
6,549,915 B2 * 4/2003 Abbott et al. ..... 707/104.1

* cited by examiner

*Primary Examiner*—Judy Nguyen
*Assistant Examiner*—Leo T Hinze
(74) *Attorney, Agent, or Firm*—Locke Lord Bissell & Liddell, LLP

(57) ABSTRACT

A display device for displaying an event and method for monitoring and displaying a time interval related to a non-displayed past event and/or a non-displayed future event. A displayed event of a person or event is displayed on a support member, such as a frame or plaque. A timer is provided to calculate an accumulating time interval and/or a reducing time interval. The accumulating time interval measures the current elapsed time from a non-displayed past event. The reducing time interval measures the time remaining from a current time to a non-displayed future event. The time intervals are displayed on a timer display that is disposed adjacent the displayed event to remind an observer of the time to a non-displayed future event and/or of the time from a non-displayed past event.

6 Claims, 3 Drawing Sheets

TIMER AND DISPLAY DEVICE

This application is a continuation of application Ser. No. 10/391,262filed Mar. 18, 2003.

FIELD OF THE INVENTION

The present invention relates to a display device having a timer disposed adjacent to a displayed event whereby the timer calculates and displays an accumulating time interval and/or a reducing time interval to a non-displayed event.

BACKGROUND OF THE INVENTION

One of the greatest rewards of parenting is being involved as a child grows and eventually matures into a young adult. However, in today's society, parents are challenged with the demands of their professional careers often at the cost of spending not just quality time, but any time, with their children. As a result, parents all too often miss the involvement in their child's life that builds the foundation for a productive future and generates a stately legacy. Involvement may include important events such as birthday parties, soccer games, school plays, etc., or simply time learning, talking and relating to one another. It is undeniable that spending time with a child is critical to a child's well-being and growth.

While career demands of some parents prevent extensive time being spent with their children during the child's early childhood and adolescent years, others simply do not effectively manage their time or realize how little time that they are spending with their children.

In order to emphasize how precious time is and how little time a parent actually can spend with his or her child before the child is matured into an adult, many parents display photographs of their children or reminders of significant events for their children or family. However these displays or reminders have no way of quantifying or emphasizing the continual passing of time (i.e., the child maturing) and the diminishing amount of time remaining before a specified event, such as the child reaching an adult age.

SUMMARY OF THE INVENTION

The present invention relates to a display device for monitoring a time interval related to a non-displayed past event or to a non-displayed future event. The display device includes a timer to calculate an accumulating and/or reducing time interval. The display device also includes a timer display that visually and continually indicates to the viewer the accumulating and/or reducing time interval. The displayed event is provided along with the timer display so that the viewer can relate the passage of time to one or more non-displayed events. For example, the device may include a picture of a child at age two coupled with a timer to calculate a reducing time with respect to the child's eighteenth birthday and/or an accumulating time with respect to the child's birth date. A support member supports the timer display adjacent the displayed event so that both are readily apparent to the viewer.

The display device is capable of numerically measuring and displaying seconds, minutes, hours, days, weeks, months, or years separately or in any combination.

The present invention displays an event associated with a child, such as a photograph, poem, or drawing, along with a time indicator. The time indicator can constantly remind a parent or other individual that time spent with their child is precious and that one day their child will mature into an adult. By combining a displayed event along with a continuing time indicator concerning one or more non-displayed events, a parent will be immediately reminded of the value of spending time with their children now, as opposed to spending it later, when little time remains before the child reaches adulthood.

The display device may also incorporate a video monitor to display the displayed event with the time intervals. A computer or semiconductor microchips can be programmed to indicate time intervals from a non-displayed past event and/or remaining time to a non-displayed future event.

When it is desirable to use the display device, the user inputs a first date that corresponds to a non-displayed past event. Such a date may include a birth date of a person, by way of example. The user then enters a second date, corresponding to the current time. Likewise, the timer can be pre-programmed for a non-displayed future event, such as a person's eighteenth birthday, or the timer can be programmed by the user to receive an input corresponding to any other non-displayed future event. The timer then can calculate the time interval from the non-displayed past event to the present time and/or calculate the time interval remaining until the non-displayed future event. Preferably, the timer display displays concurrently both such time intervals.

The support member can be stand-alone or it can be selectively attachable with other support members, e.g., if multiple display devices are desirable.

DESCRIPTION OF THE PREFERRED EMBODIMENTS

Figure 1:
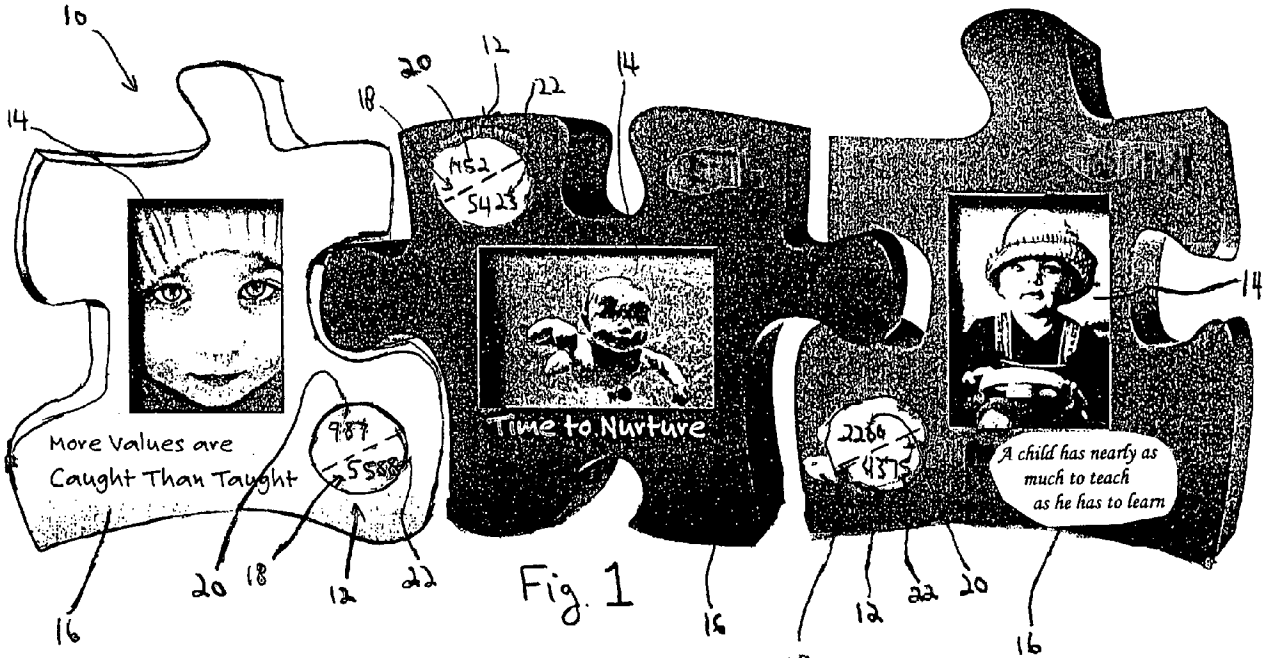
FIG. 1 illustrates a front view of the display device.

A display device 10 that continually indicates to the viewer an accumulating and/or reducing time period related to a non-displayed event is illustrated in FIG. 1. Display device 10 includes a timer 12, a displayed event 14 and a support member 16 for supporting items 12 and 14.

Timer 12 includes a processor designed to measure time intervals including seconds, minutes, hours, days, weeks, months, and years individually or in any combination. The type of timer used in the invention, which can be chemical, mechanical, or electronic, is meant as a device to measure and indicate accumulating or reducing time periods.

Figure 2:
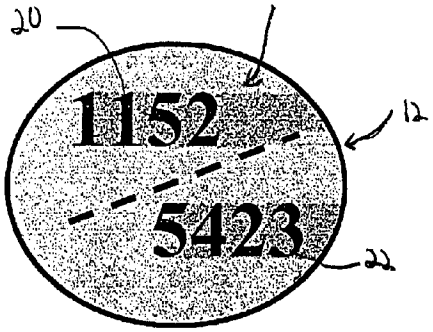
FIG. 2 illustrates the timer display of the timer.
Figure 6:
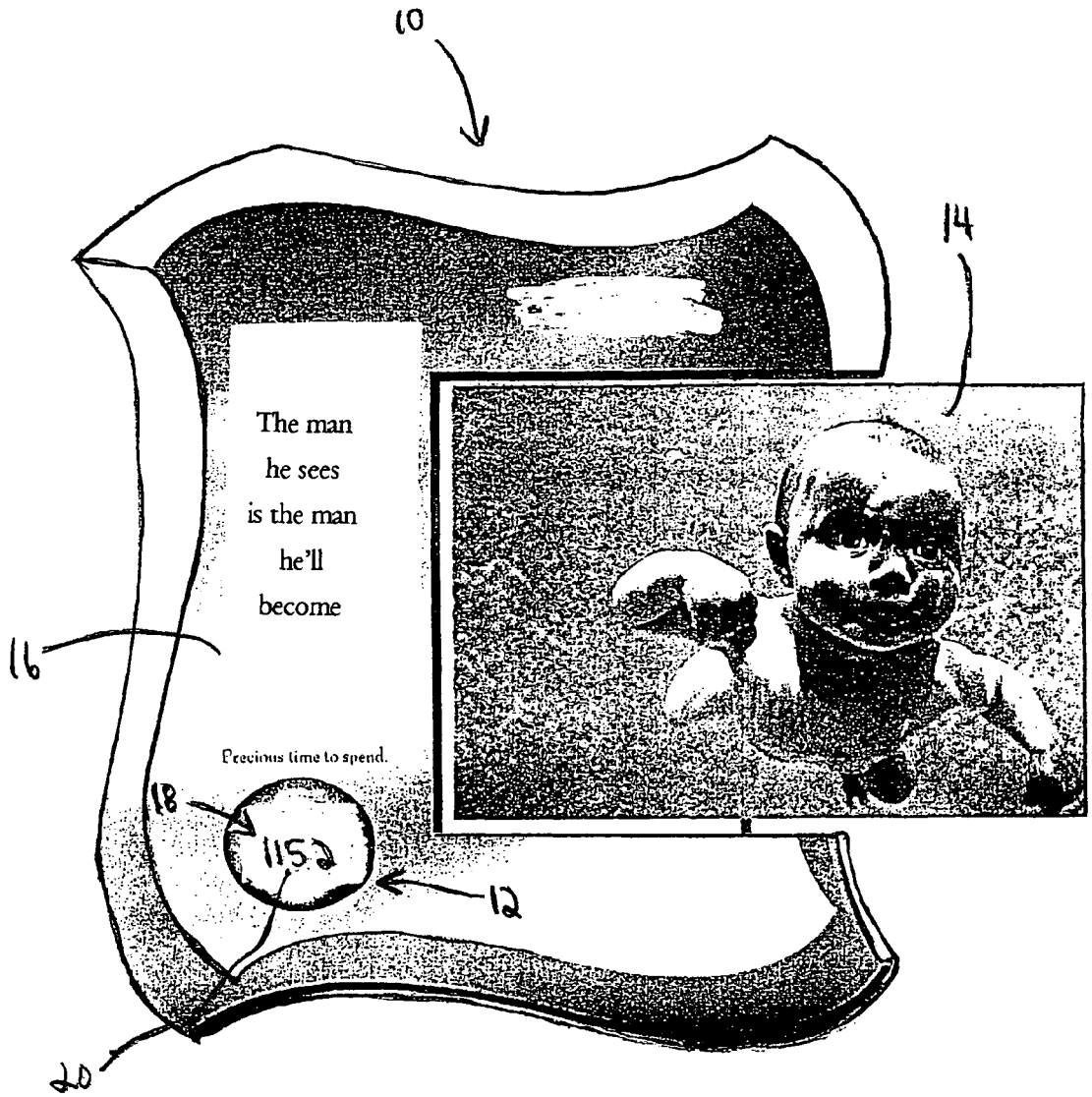
FIG. 6 illustrates the present display device having a timer indicating a reducing time.

As illustrated in FIGS. 1 and 2, a timer display 18 may be combined with timer 12 or be a separate component provided with time interval information from timer 12. When timer 12 is measuring intervals from a past event, the accumulating time 20 is shown on timer display 18. When timer 12 is measuring time to a future event, the remaining or reducing time 22 is illustrated on timer display 18. In a preferred embodiment, both the accumulating time 20 and the reducing time 22 are displayed concurrently on timer display 18, as best seen in FIG. 2. Accumulating time 20 and reducing time 22 can be each displayed in alternating fashion on display 18 or individually, as seen in FIG. 6.

Timer 12, in addition to measuring time intervals, can perform functions well known in the timer art such as for continued operation in the event of any power failure, a function to compensate for changing time zones or daylight savings times, and a function to account for leap years. The power source for timer 12 may be solar, chemical, alternating or direct electrical current or mechanical power devices, individually or combined. In a preferred embodiment, a lithium battery concealed within timer 12 is used with a reserve power source to temporarily maintain the settings while the battery is being changed. A device to signal low power may be included with battery driven power sources. When a low battery condition exists, the accumulating time 20 and/or reducing time 22 on timer display 18 may blink to signal the low battery condition.

Timer display 18 may be coordinated with timer 12 to display time intervals of seconds, minutes, hours, days, weeks, months and years individually or in any combination. As seen in FIGS. 1 and 2, timer display 18 is seen displaying intervals of days. Timer display 18 may represent the time intervals in numeric, graphic or text form. Timer display 18 uses liquid crystal displays or analog display faces of time measurement to indicate time intervals but is not limited to these display methods. Timer display 18 may be lighted. Descriptive time word units such as seconds, minutes, hours, days, weeks, months, or years can be optionally placed on either timer display 18 or support member 16.

Displayed event 14 includes but is not limited to any type of photo, word, picture, theme, etc. relating or reminding a viewer of a non-displayed past event (e.g., birth date) and or a non-displayed future event (e.g., an eighteenth birthday).

Non-displayed past events, by which timer 12 computes accumulating time 20, preferably includes a child-birth date; however, it should be realized by one of ordinary skill that past events may include weddings, deaths, vacations, anniversaries, assemblies, employment, or religious holidays. Non-displayed future events, by which timer 12 computes the reducing time 22, preferably includes birthdays. Other non-displayed future events may include program or project deadlines, engagements, births, patent application deadlines, patent expirations, retirements, end of incarcerations, end of military service, graduation dates, vacation times, document expirations, certificate expirations, sports events, religious dates or any type of goal or event.

The time associated with the occurrence of the non-displayed event may be displayed together with displayed event 14 (FIGS. 1 and 6). Thus, support member 16 is configured for supporting and displaying timer 12 and displayed event 14. By displaying displayed event 14 with timer display 18, the viewer can be constantly reminded of the upcoming and important non-displayed event, such as the time to a future birthday. Accumulating time 20 and remaining time 22 alert the observer of the accumulated time that has elapsed since a non-displayed past event (i.e., child birth date) while also alerting the observer of the time remaining until the non-displayed future event (i.e., child's eighteenth birthday). This may be particularly valuable to parents who rarely quantify the continual passage of time and the continuously diminishing amount of time remaining before a future event, such as their child reaching adulthood. As a result, parents may be more motivated to make additional efforts to spend more time with their children before they grow older and/or reaches adulthood.

Referring specifically to FIG. 6, timer display 18 is illustrated with displayed event 14. Timer display 18 displays only the time remaining 22 to the non-displayed future event. In the alternative, timer display 18 can display accumulating time 20, if desired.

Support member 16 may include but is not limited to a single frame or a plaque of any shape or size. Support member may be square, rectangular, oval shaped, or any other desired shape. If desired, multiple support members 16 can be interlocked together. As seen in FIG. 1, support members 16 can each resemble a puzzle piece that can be interlocked together. Display device 10 can be attached to a wall, displayed on surfaces, made into jewelry, or adapted to any other object. Support member 16 may be constructed from but is not limited to plastic, glass, crystal, stone, metal, wood, clay, paper, or combinations of these materials. A single support member 16 may include a plurality of timers 12 and/or timer displays 18 and/or a plurality of displayed events 14.

Figure 4:
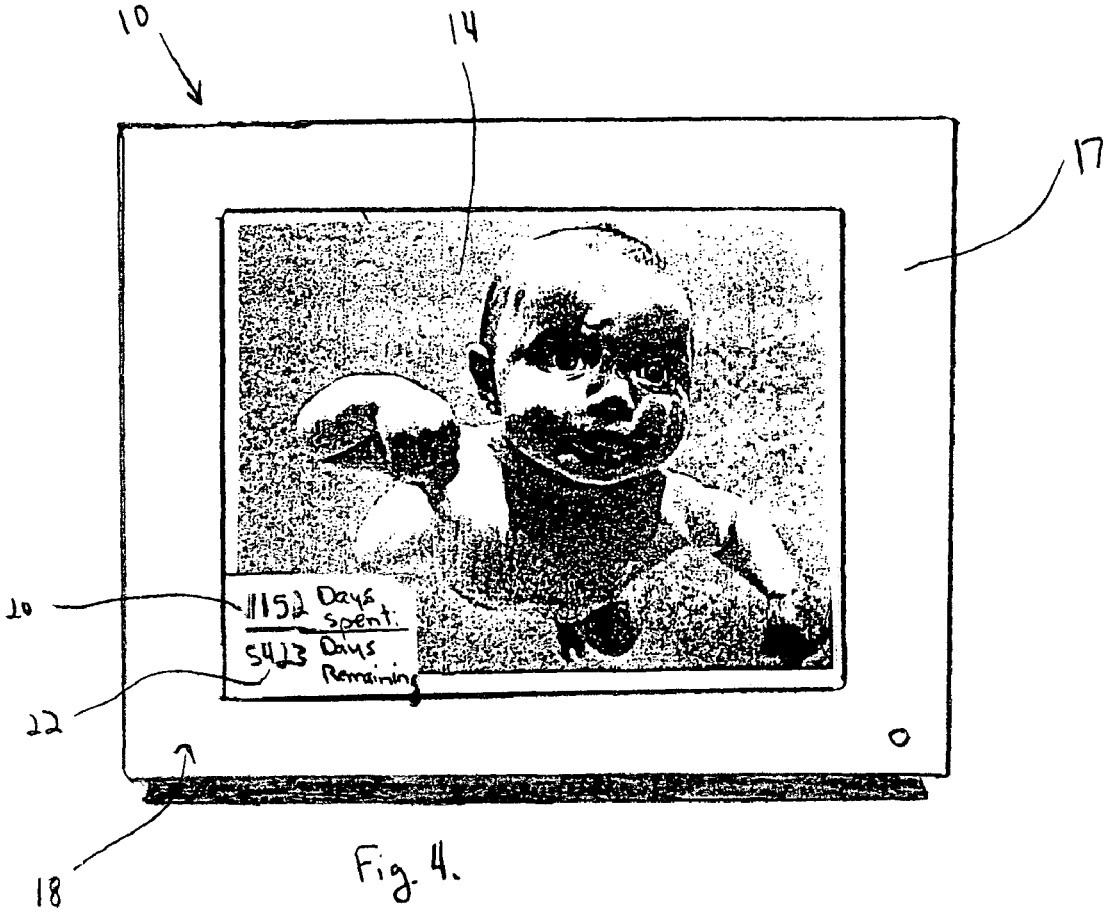
FIG. 4 illustrates the display device incorporating a video monitor.

As seen in FIG. 4, a video monitor 17 may incorporate displayed event 14 and timer display 18. If used with a computer (not shown), displayed event 14 can be scanned from a photograph, document, or any other source, and displayed on the video monitor 17. When used with a computer monitor, displayed event 14 can be maintained in memory with the appropriate timer display 18. The timer 12 and displayed event 14 can be on the same screen and shown as "wall paper" or the "desk top" during computer operation to make the computer user aware of displayed time intervals.

Figure 3:
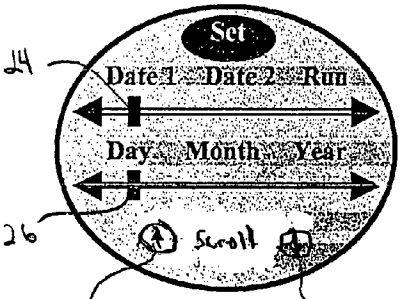
FIG. 3 illustrates the programming switches of the timer.

Referring to FIG. 3, timer 12 can include switches 24 and 26 used to program the timer 12. Switch 24 is preferably a three-position switch having a "date 1" position, a "date 2" position and a "run" position. Furthermore, switch 26 is preferably a three-position switch having a "day" position, a "month" position and a "year" position.

When programming timer 12, switch 24 is placed in the date 1 position for inputting the day, month and year of the first date. As explained previously, the first date can be any past event date such as a date of birth, date of marriage, date of employment, etc. To input the first date, switch 26 is placed in the "day" position and buttons 28 and 30 are pushed to scroll to the desired number corresponding to the day of the month. This process is repeated for the month and year as switch 26 is placed in the "month" and "year" positions. After the first date is input into timer 12, the second date, which corresponds to the current date, is input into timer 12. Switch 24 is placed at the date 2 position and the above-mentioned process is repeated. After the first and second dates are input into timer 12, switch 24 is placed in the "run" position. While in the "run" position, an internal processor can calculate the remaining time from the previously input first or second date until a third date corresponding to a non-displayed future event date, such as an eighteenth birthday. Moreover, an internal processor can calculate the third date itself on the basis of time intervals calculated from the previously input first and/or second dates. In this regard, the process for calculating the third date and/or the referenced time intervals by means of an internal processor is currently well known in the art. In yet another embodiment of the invention, the third date is either a factory-set preprogrammed future event date or a non-displayed future event date input by the user.

During use, user will provide a displayed event 14. The user then inputs the first date corresponding the a non-displayed past event, a second date corresponding to the present time, and a third date corresponding a non-displayed future event. After all dates have been input, timer 12 calculates the time interval from the non-displayed past event to the present time and also calculates the time interval remaining from the present time to the non-displayed future event. Finally, the calculated time intervals are concurrently displayed on timer display 18 with the displayed event.

Figure 5:
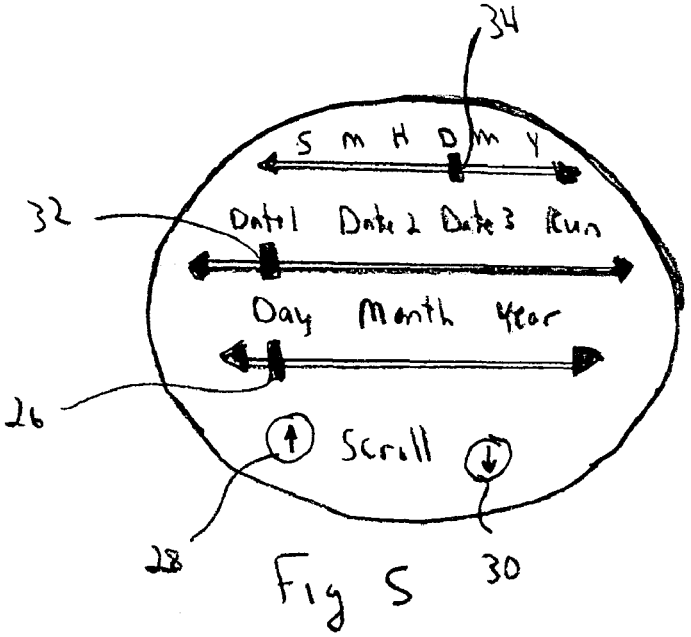
FIG. 5 illustrates the programming switches for an additional embodiment of the timer.

A selector switch 34 (FIG. 5) can optionally be provided to allow the viewer to select the units desired for time intervals 20 and 22 in either seconds (S), minutes (M), hours (H), days (D) or years (Y). Time intervals may also be at differing rates of time and not limited to solar time. Examples of one such time rate would be time interval and event display device that keeps track of pet ages, e.g., dog's ages, which would be at seven times the normal rate of solar time.

Although the preferred embodiments of the present invention have been illustrated in the accompanying Figures and described above, it will be understood that the invention is not limited to the embodiments disclosed but is capable of numerous rearrangements, modifications and substitutions of parts and elements without departing from the spirit of the invention.

I claim:

1. A method of measuring and monitoring time intervals related to a non-displayed past event and a non-displayed future event comprising the steps of:

displaying an event;

inputting a first date corresponding to a non-displayed past event;

inputting a second date corresponding to a present time;

calculating a third date corresponding to the non-displayed future event;

calculating the time interval from the non-displayed past event to said present time;

calculating the time interval remaining from the present time to the non-displayed future event; and concurrently displaying the calculated time interval from the non-displayed past event to said present time and the calculated time interval remaining from the present time to the non-displayed future event with the displayed event.

2. The method of claim 1 wherein said step of displaying an event is performed in a picture frame.

3. The method of claim 2 wherein said picture frame is shaped like a puzzle piece.

4. A method of measuring and monitoring a time interval related to a non-displayed past event comprising the steps of:

displaying an event;

inputting a first date corresponding to a non-displayed past event;

inputting a second date corresponding to a present time;

calculating the time interval from the non-displayed past event to said present time; and displaying the calculated time interval from the non-displayed past event to said present time with the displayed event.

5. The method of claim 4 wherein said step of displaying an event is performed in a picture frame.

6. A method of measuring and monitoring a time interval related to a non-displayed future event comprising the steps of:

displaying an event;

inputting a first date corresponding to a non-displayed future event;

inputting a second date corresponding to a present time;

calculating the time interval from the non-displayed future event to said present time; and displaying the calculated time interval from the non-displayed future event to said present time with the displayed event.

* * * * *